US011479005B2

(12) United States Patent
Bevc et al.

(10) Patent No.: US 11,479,005 B2
(45) Date of Patent: Oct. 25, 2022

(54) PRESSURE PIN OF A PRESS AND PRESS HAVING PRESSURE PIN

(71) Applicant: Bayerische Motoren Werke Aktiengesellschaft, Munich (DE)

(72) Inventors: Boris Bevc, Munich (DE); Philipp Craighero, Freising (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 357 days.

(21) Appl. No.: 16/797,999

(22) Filed: Feb. 21, 2020

(65) Prior Publication Data

US 2020/0189221 A1 Jun. 18, 2020

Related U.S. Application Data

(63) Continuation of application No. PCT/EP2018/070650, filed on Jul. 31, 2018.

(30) Foreign Application Priority Data

Aug. 22, 2017 (DE) ..... 10 2017 214 660.5

(51) Int. Cl.
*B30B 1/42* (2006.01)
*F15B 21/06* (2006.01)

(52) U.S. Cl.
CPC ..... *B30B 1/42* (2013.01); *F15B 21/065* (2013.01)

(58) Field of Classification Search
CPC . B29C 2043/5808; B30B 15/14; B30B 15/28; B21D 22/10; B21D 22/12; F15B 21/065
See application file for complete search history.

(56) References Cited

U.S. PATENT DOCUMENTS 5,253,505 A * 10/1993 Baur ..... B21D 24/14 72/361
5,295,383 A * 3/1994 Kirii ..... B21D 24/14 72/453.13
5,692,404 A * 12/1997 Kirii ..... B21D 24/00 72/15.1

(Continued)

FOREIGN PATENT DOCUMENTS

CN 101319750 A 12/2008
CN 102606664 A 7/2012

(Continued)

OTHER PUBLICATIONS

PCT/EP2018/070650, International Search Report dated Dec. 4, 2018 (Three (3) pages).

(Continued)

*Primary Examiner* — Matthew Katcoff
(74) *Attorney, Agent, or Firm* — Crowell & Moring LLP

(57) ABSTRACT

A pressure pin of a press, in particular a forming press, for transferring a force to a tool component of the press includes a pin body, a sensor element arranged in the pin body for measuring a force which can be transferred via the pressure pin, and an actuator unit arranged in the pin body which has a functional body made of an adaptive material. The adaptive material is designed such that the rheological properties thereof and/or the length thereof and/or the volume thereof can be selectively modified as a function of an electrical and/or magnetic field.

11 Claims, 3 Drawing Sheets

(56) References Cited

U.S. PATENT DOCUMENTS

| | | | | |
|---|---|---|---|---|
| 6,116,144 | A * | 9/2000 | Rosenfeldt | F15B 21/065 91/418 |
| 8,302,517 | B2 * | 11/2012 | Fahrenbach | B21D 28/20 83/684 |
| 2008/0302024 | A1 | 12/2008 | Browne et al. | |
| 2013/0079470 | A1 | 3/2013 | Nojiri et al. | |
| 2016/0008878 | A1 | 1/2016 | Schramm et al. | |
| 2020/0220445 | A1 * | 7/2020 | Klein | F15B 21/08 |

FOREIGN PATENT DOCUMENTS

| | | | | |
|---|---|---|---|---|
| CN | 203449626 | U | 2/2014 | |
| CN | 204686629 | U | 10/2015 | |
| CN | 106438591 | A | 2/2017 | |
| CN | 106594157 | A | 4/2017 | |
| CN | 105665510 | B | 7/2017 | |
| DE | 3735581 | C1 * | 10/1987 | B21D 24/14 |
| DE | 199 54 310 | A1 | 5/2001 | |
| DE | 103 31 939 | A1 | 2/2005 | |
| DE | 10 2006 031 438 | B4 | 1/2008 | |
| DE | 10 2007 040 130 | B3 | 11/2008 | |
| DE | 10 2008 026 386 | A1 | 2/2009 | |
| DE | 10 2012 202 778 | A1 | 8/2012 | |
| DE | 10 2012 018 608 | A1 | 3/2013 | |
| DE | 10 2012 002 213 | A1 | 8/2013 | |
| DE | 10 2012 018 606 | A1 | 3/2014 | |
| DE | 10 2013 020 646 | A1 | 6/2015 | |
| DE | 10 2014 004 521 | A1 | 10/2015 | |
| DE | 10 2014 221 550 | A1 | 4/2016 | |
| DE | 10 2015 203 226 | A1 | 8/2016 | |
| DE | 10 2015 116 039 | A1 | 3/2017 | |
| DE | 102015116039 | A1 * | 3/2017 | B21D 24/02 |
| EP | 3 012 038 | A1 | 4/2016 | |
| KR | 10-2006-0006922 | A | 1/2005 | |
| KR | 10-2008-0011609 | A | 2/2008 | |
| KR | 10-1452734 | B1 | 10/2014 | |
| WO | WO 03/013759 | A1 | 2/2003 | |

OTHER PUBLICATIONS

German Search Report issued in German counterpart application No. 10 2017 214 660.5 dated Apr. 25, 2018, with Statement of Relevancy (Six (6) pages).

English-language Chinese Office Action issued in Chinese application No. 201880038321.7 dated Feb. 3, 2021 (Eight (8) pages).

English machine translation, which was previously cited on Feb. 21, 2020 (Four (4) pages).

English-language Chinese Office Action issued in Chinese application No. 201880038321.7 dated Aug. 17, 2021 (Ten (10) pages).

Zhongbing Wang, "EAF—Thin Slab Continuous Casting and Rolling", Nov. 30, 2004, partial English translation, Four (4) pages.

* cited by examiner

PRESSURE PIN OF A PRESS AND PRESS HAVING PRESSURE PIN

CROSS REFERENCE TO RELATED APPLICATIONS

This application is a continuation of PCT International Application No. PCT/EP2018/070650, filed Jul. 31, 2018, which claims priority under 35 U.S.C. § 119 from German Patent Application No. 10 2017 214 660.5, filed Aug. 22, 2017, the entire disclosures of which are herein expressly incorporated by reference.

BACKGROUND AND SUMMARY OF THE INVENTION

A pressure pin for a press is described, which is designed to transmit a force to a tool component of the press. The press may, for example, be a forming press. Furthermore, a press with at least one such pressure pin is described.

In order to produce sheet metal parts for vehicle bodies by means of cold forming, production processes are performed which comprise several operations. The first forming operation is usually the drawing stage. The forming tool used for the drawing stage normally consists of a female die, a male die and a panel holder. Additional components such as the top box and bottom box, or slide, inserts, etc., may also be contained in the forming tool. If the forming tool comprises boxes, normally the top box is fixedly connected to the female die and the bottom box is fixedly connected to the male die. Lower air pins which are fixedly connected to the panel holder are arranged on the underside of the panel holder.

The forming tool is operated in a forming press provided to this end. Here, the female die or top box is attached to the ram. The male die or bottom box is attached to the table plate. The panel holder with the lower air pins stands on the press sleeves which in turn stand on the pressure pad. The pressure pad stands on hydraulic cylinders and is fixedly connected thereto. The number of hydraulic cylinders may vary according to the press. The panel to be formed lies on the panel holder. One or more spacers may be situated between the panel holder and the female die, in order to influence the gap between the two tool components. During the forming process, the ram moves vertically downward and in doing so displaces the entire system comprising panel holder, press sleeves and pressure pad. The hydraulic cylinders here exert a counter force which is conducted into the press sleeves and lower air pins via the pressure pad, and into the panel holder. This process is described in publication DE 199 543 10 A1.

In this operation, the properties and quality of the formed components depends quite substantially on the material flow in the panel, which takes place in the contact region between the female die and the panel holder. The material flow is decisively influenced by the pressure distribution between the panel and the panel holder.

The pressure distribution between the panel and the panel holder in the process described above is produced by the introduction of force by the hydraulic cylinders into the panel holder, and by the spacing achieved using spacers. It is desirable to adjust the pressure distribution between the panel holder and panel not only before but also during the forming process, in order to achieve an optimal forming result.

One possibility is to influence the pressure distribution via the hydraulic cylinders. A method which partially uses manipulation of the hydraulic cylinders to vary the pressure distribution between the panel and the panel holder is described in publication DE 199 543 10 A1. The pressure distribution between the panel and panel holder may also be varied during the forming process via piezo-actuators. In publication DE 199 543 10 A1, there is no measurement of the actual force.

A further possibility lies in manipulation of the spacers. The height of the spacers can be influenced by hydraulic, pneumatic, electrical or other means. A variation in the height of the spacers has a direct effect on the pressure distribution between the panel and panel holder. Such methods are described for example in publications DE 10331939 A1, DE 102006031438 B4, DE 102012018606 A1, DE 102012002213 A1, DE 102012202778 A1, DE 102014221550 A1 or DE 102015203226 A1.

Furthermore, publication DE 102014004521 A1 describes a pressing device in which a force transmission element is configured as an actuator which can be actuated electrically, hydraulically or pneumatically.

Publication KR 20080011609 A describes a method for extending the service life of a forming press and reducing the vibrations produced in the forming press. For this, magnetorheological lower air pins are used, and piezo-electric sensors in the spacers. The piezo-electric sensors in the spacers measure the forming forces and transmit a control signal to the magnetorheological lower air pins.

The disadvantage of the forming press described in publication KR 10080011609 A is that the forming forces are measured in the spacers and hence only in force shunt.

An object to be achieved by at least some embodiments is to indicate a pressure pin of a press, by means of which the forming forces can be measured directly in the force flow. Furthermore, the forming forces can also be measured in tools without spacers. A further object is to indicate a press with at least one such pressure pin.

The pressure pin described here, according to at least one embodiment, comprises a pin body and a sensor element arranged or integrated in the pin body for measuring a force which can be transmitted via the pressure pin. Furthermore, the pressure pin comprises an actuator unit arranged or integrated in the pin body. The actuator unit has a functional body made of an adaptive material. The sensor element and/or the actuator unit may be arranged, for example, in a recess in the pin body.

Preferably, the pressure pin is designed to transmit a force to a tool component of the press, for example to transmit a force to a panel holder of a forming press. The force may be transmitted directly to the tool components, or indirectly via further elements to the tool components. For example, the pressure pin may be arranged between a pressure pad of a press and a panel holder of the press.

The adaptive material of the functional body is preferably designed such that its rheological properties and/or length and/or volume can be selectively modified as a function of an electrical and/or magnetic field. For example, the viscoelastic and/or dynamic-mechanical properties of the adaptive material may be selectively varied. In particular, a reversible deformation is possible, such as, for example, an extension and/or a reversible hardening or stiffening of the adaptive material.

The sensor element is preferably designed to measure a force which is or can be transmitted via the pressure pin or pin body of the pressure pin. In particular, the sensor element may be a force sensor. For example, the sensor element may have one or more strain gauges. The sensor element may, for example, comprise a Wheatstone measuring bridge which comprises a plurality of strain gauges.

The pressure pin may be configured, for example, as a so-called lower air pin or middle air pin or middle pin. The lower air pin preferably contacts the panel holder directly, or is directly connected to the panel holder. For example, the lower air pin may be screwed to the panel holder or formed integrally with the panel holder. In particular, the lower air pin may be arranged between a further pressure pin of the press, such as, for example, a press sleeve, and the panel holder.

Furthermore, the pressure pin may be configured as a press sleeve. For example, the pressure pin may be arranged between the pressure pad of a press and a further pressure pin, such as, for example, a lower air pin.

According to a further embodiment, the adaptive material is a fluid. For example, the adaptive material may be a magnetorheological fluid or an electrorheological fluid. The adaptive material may in particular be configured such that a reversible stiffening of the fluid can be provoked in a targeted fashion.

According to a further embodiment, the adaptive material is an elastomer. The elastomer may, for example, be a magnetorheological elastomer or a dielectric elastomer. For example, a targeted reversible deformation, such as, for example, extension and/or hardening, of the adaptive material may take place.

According to a further embodiment, the actuator unit comprises means for forming an electrical and/or magnetic field. For example, the actuator unit may comprise a coil, e.g., a copper coil. In addition or alternatively, the actuator unit may, for example, have capacitor plates. By producing the electric and/or magnetic field, the rheological properties and/or the length and/or the volume of the functional body or adaptive material may be modified in targeted fashion.

Furthermore, the actuator unit may have a movable piston. Preferably, the piston of the actuator unit can be moved by means of the functional body. The body may be moved, for example, by expansion or volume change of the adaptive material relative to the rest of the pin body. In this way, the pressure pin may also be configured with variable length.

According to a further embodiment, the sensor element and the actuator unit are connected together via a control circuit. The signals from the sensor element may, for example, be compared with a reference variable, and any possible value deviation may be taken into account by a regulator controlling the actuator unit. Depending on the signals from the regulator, for example, the means for producing the electrical and/or magnetic field may be varied such that a targeted change in the adaptive material of the functional body can take place. The force transmitted by the pressure pin may again be measured by the sensor element and a comparison made with the reference variable.

Furthermore, a press is indicated with at least one pressure pin described here. The pressure pin of the press may have one or more features of the embodiments described above.

For example, the press may be configured as a forming press. Furthermore, the press comprises at least one pressure pin described here with a sensor element and an actuator unit, which, for example, may be configured as a lower air pin or as a press sleeve. Particularly preferably, a plurality of pressure pins of the press tool, and/or a plurality of pressure pins of the press table, are configured as a pressure pin described here with a sensor element and an actuator unit. By means of the sensor element or elements, preferably an on-line measurement can take place during the pressing process.

The press described herein has a multiplicity of advantages. For example, the pressure distribution between the panel and panel holder can be varied very easily during the forming process. Furthermore, a significantly greater travel is possible than with piezo-actuators.

The concept described is also very robust against rapidly occurring pressure peaks in the press and tool. Furthermore, the sensor element and the actuator unit lie as close as possible to each other and are situated in the same component, and the sensor element and actuator unit lie directly in the force flow.

In addition, usually significantly more pressure pins than spacers are present in the forming tool, and the technical solution may also be implemented in tools without spacers.

Advantageously, there is no need to supply and extract hydraulic or pneumatic media. Furthermore, a small construction volume of sensor element and actuator unit is possible. Because of the small construction volume of sensor element and actuator unit, the pressure pin may, for example, have the same dimensions as conventional lower air pins or press sleeves.

Further advantages and advantageous embodiments of the pressure pin described herein or the press described herein arise from the following description in connection with the embodiments shown in FIGS. 1 to 4.

Other objects, advantages and novel features of the present invention will become apparent from the following detailed description of one or more preferred embodiments when considered in conjunction with the accompanying drawings.

DETAILED DESCRIPTION OF THE DRAWINGS

In the exemplary embodiments and the Figures, the same components or those with the same function carry the same reference signs. The elements depicted and their size ratios to each other should not in principle be regarded as true to scale. Rather, individual elements may be shown excessively thick or large for greater clarity and/or better understanding.

Figure 1:
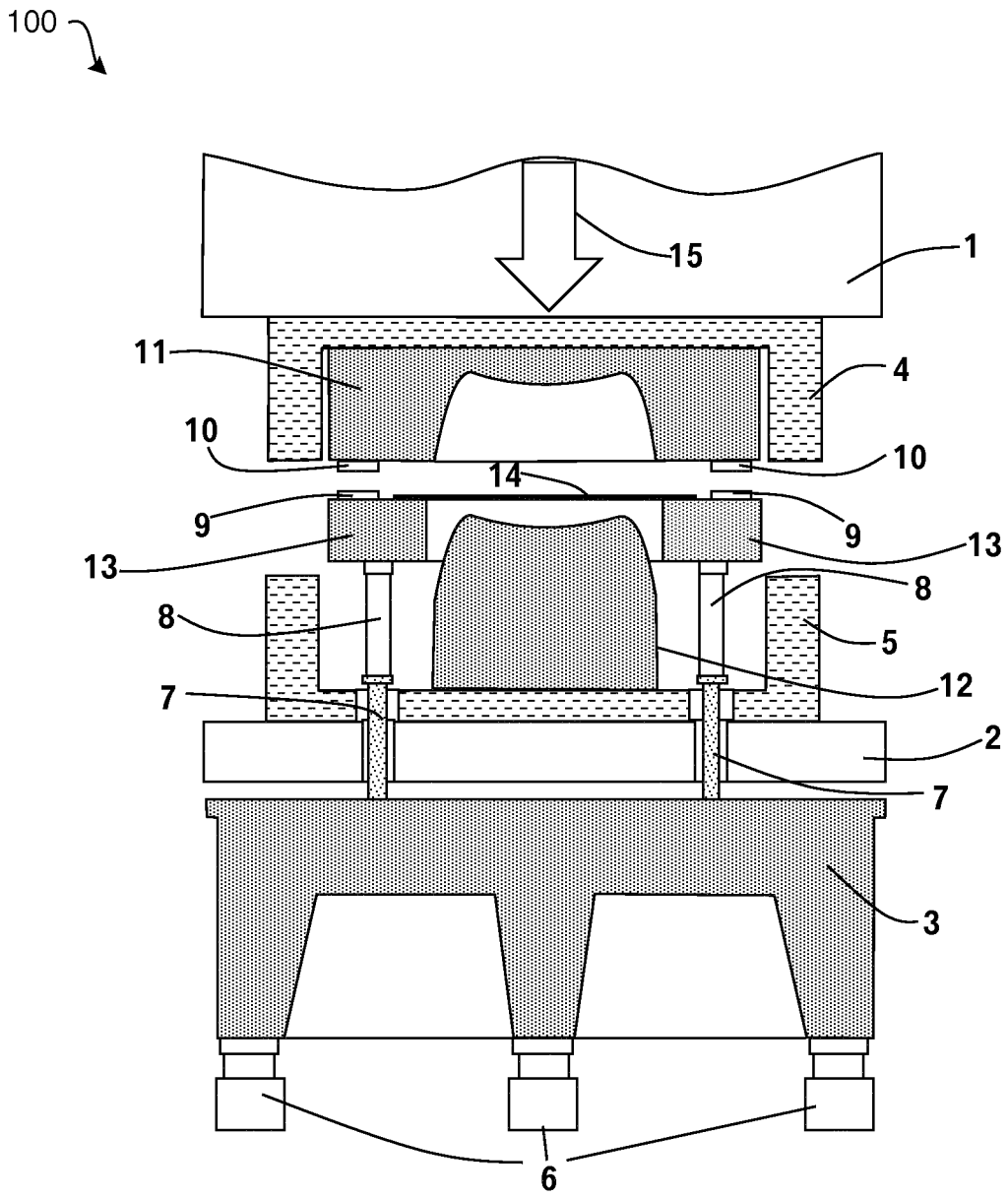
FIG. 1 is a diagrammatic view of a press according to one exemplary embodiment.

FIG. 1 shows a diagrammatic view of a press 100 described herein, according to a first exemplary embodiment. The press 100 is configured as a forming press for forming a plate 14, and has a ram 1, a table plate 2, a top box 4 and bottom box 5 arranged in between, a pressure pad 3 and a plurality of hydraulic cylinders 6. Furthermore, the press 100 has a plurality of press sleeves 7 which are configured to transmit the force from the hydraulic cylinders 6 to the pressure pins 8 which are configured as lower air pins. Preferably, at least one of the pressure pins 7, 8 is configured as a pressure pin described herein, which is shown in more detail in FIGS. 2 and 3. Further elements of the press 100 are the female die 11, the male die 12, the panel holder 13, the spacer plate on the underside 9, and the spacer plate on the top side 10. The working direction of the ram during a forming process is indicated with reference sign 15.

Figure 2:
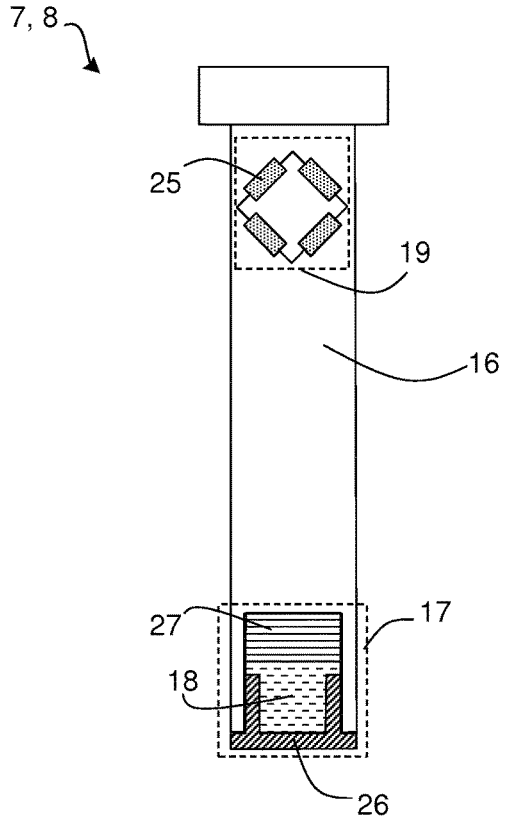
FIG. 2 is a diagrammatic view of a pressure pin according to a first exemplary embodiment.

FIG. 2 shows a diagrammatic view of a pressure pin according to a first exemplary embodiment. The pressure pin may be, for example, a lower air pin 8 or a press sleeve 7 of a press 100. The pressure pin has a pin body 16 and a sensor element 19 arranged in the pin body 16 for measuring a force which can be transmitted via the pressure pin. In the exemplary embodiment shown, the sensor element 19 has a plurality of strain gauges which are connected into a Wheatstone measuring bridge 25.

Furthermore, the pressure pin has an actuator unit 17 which is arranged in the pin body 16 and has a functional body 18 made of an adaptive material, a coil 27 for producing a magnetic field, and a piston 26. Preferably, the adaptive material is configured such that its rheological properties and/or length and/or volume can be modified selectively as a function of the magnetic field which can be produced by the coil 27.

The adaptive material may be, for example, a magnetorheological fluid or a magnetorheological elastomer. The magnetic field produced by the coil 27 may cause the adaptive material to expand, whereby the piston 26 can be moved relative to the rest of the pin body.

Figure 3:
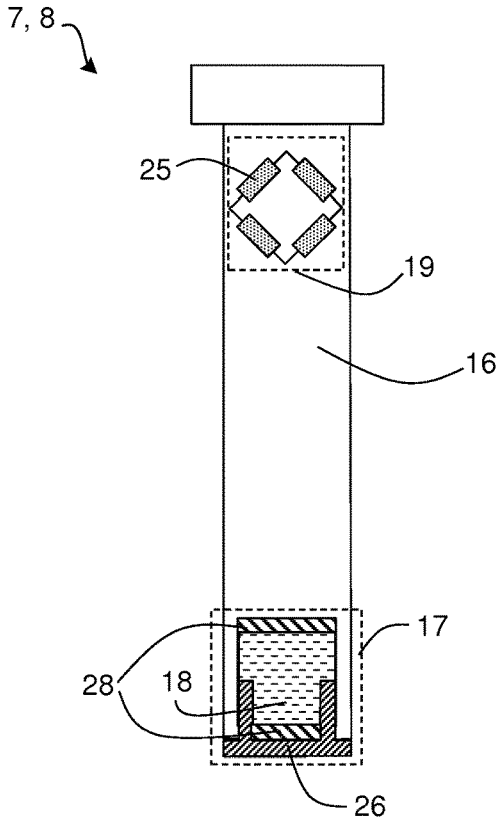
FIG. 3 is a diagrammatic view of a pressure pin according to a second exemplary embodiment.

FIG. 3 shows a diagrammatic view of a pressure pin 7, 8 according to a further exemplary embodiment. In contrast to the exemplary embodiment in FIG. 2, the actuator unit 17 comprises two capacitor plates 28, between which the functional body 18 is arranged and which are designed to produce an electrical field. By means of the electrical field produced by the capacitor plates 28, the adaptive material of the functional body 18 may be modified such that the piston 26 moves relative to the rest of the pin body.

Figure 4:
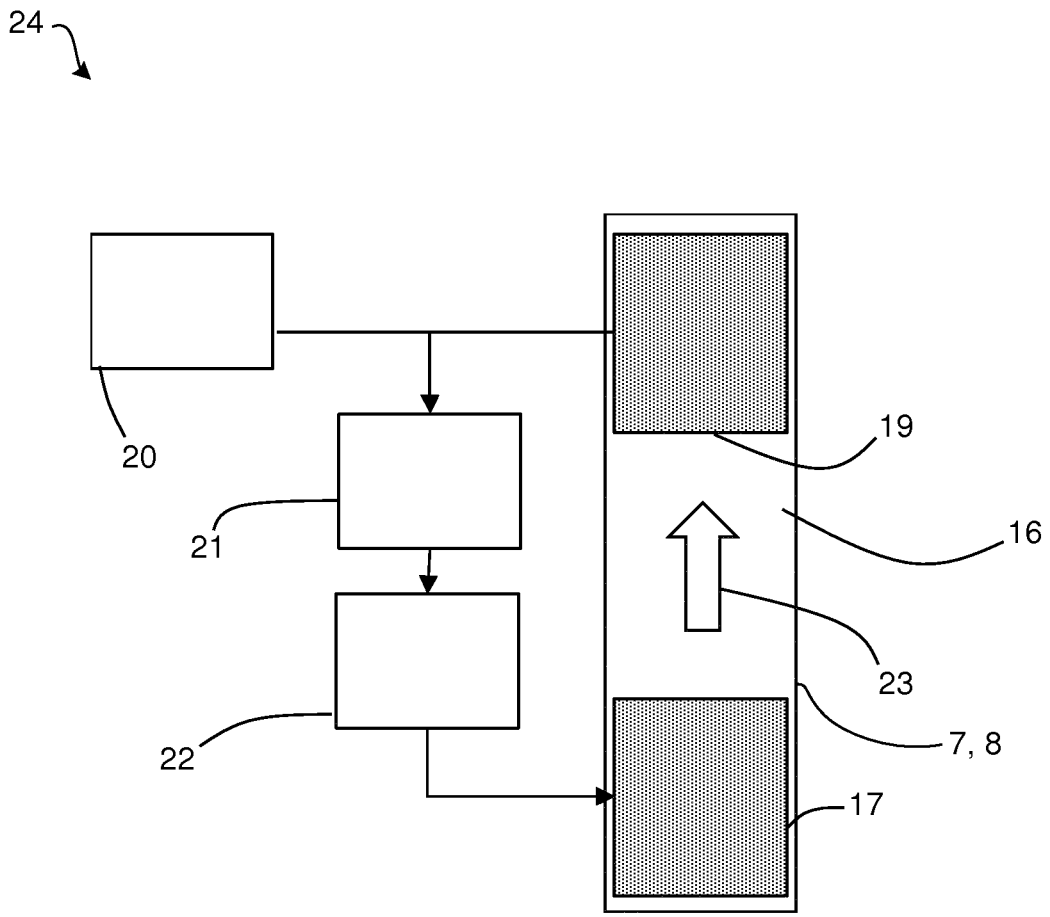
FIG. 4 is a diagrammatic view of a control circuit of a press with at least one pressure pin described herein, according to a further exemplary embodiment.

FIG. 4 shows a diagrammatic depiction of a control circuit 24, via which the sensor element 19 and the actuator unit 17 of the pressure pin 7, 8 can be connected.

By comparing a reference variable 20 with the values of the sensor element 19, a value deviation 21 may be determined. Depending on the value deviation 21, corresponding signals may be given to the regulator 22 of the control circuit 24 which then in turn emits signals to the actuator unit 17, so that a targeted adjustment of the actuator unit may take place. In particular, the means 27, 28 for producing the electrical and/or magnetic field may be varied such that the functional body 18 or the adaptive material of the functional body 18 is selectively modified, whereby the piston 26 can be adjusted relative to the pin body 16.

The transmitted force 23 may in turn be measured by the sensor element 19 and compared with the reference variable 20. Thus an on-line measurement is advantageously possible, so that the pressure distribution between the panel holder and the panel can also be adjusted or controlled and regulated during the forming process.

The features described in the exemplary embodiment shown may be combined with each other in further exemplary embodiments. Alternatively or additionally, the exemplary embodiments shown in the Figures may comprise further features according to the embodiments of the general description.

LIST OF REFERENCE CHARACTERS

1 Ram
2 Table plate
3 Pressure pad
4 Top box
5 Bottom box
6 Hydraulic cylinder
7 Press sleeve
8 Lower air pin
9 Spacer plate, lower side
10 Spacer plate, upper side
11 Female die
12 Male die
13 Panel holder
14 Plate
15 Working direction of ram during forming process
16 Pin body
17 Actuator unit
18 Functional body
19 Sensor element
20 Reference variable
21 Value deviation
22 Regulator
23 Force
24 Control circuit
25 Wheatstone measuring bridge
26 Piston
27 Coil
28 Capacitor plates
100 Press The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A pressure pin of a press for transmitting a force to a tool component of the press, comprising:

a pin body;

a sensor element disposed in the pin body, wherein a force which is transmitted via the pressure pin is measurable by the sensor element; and an actuator unit disposed in the pin body, wherein the actuator unit has a functional body made of an adaptive material;

wherein rheological properties and/or a length and/or a volume of the adaptive material is selectively modifiable as a function of an electrical and/or a magnetic field;

wherein the adaptive material is an elastomer.

2. The pressure pin according to claim 1, wherein the adaptive material is a magnetorheological elastomer.

3. The pressure pin according to claim 1, wherein the adaptive material is a dielectric elastomer.

4. The pressure pin according to claim 1, wherein the pressure pin is disposed between a pressure pad and a panel holder of the press.

5. The pressure pin according to claim 1, wherein the pressure pin is a lower air pin.

6. The pressure pin according to claim 1, wherein the pressure pin is a press sleeve.

7. The pressure pin according to claim 1, wherein the sensor element and the actuator unit are connected together via a control circuit.

8. The pressure pin according to claim 1, wherein an electric and/or a magnetic field is formable by the actuator unit.

9. The pressure pin according to claim 1, wherein the actuator unit has a piston which is movable by the functional body.

10. A press, comprising:

at least one pressure pin according to claim 1; and a control circuit, wherein the sensor element and the actuator unit of the pressure pin are connected together via the control circuit.

11. The press according to claim 10, wherein the press has a plurality of pressure pins.

* * * * *